US008882649B2

(12) United States Patent
Nakamura

(10) Patent No.: US 8,882,649 B2
(45) Date of Patent: Nov. 11, 2014

(54) FOLDING DEVICE AND SHEET FOLDING METHOD

(75) Inventor: Shigeaki Nakamura, Osaka (JP)

(73) Assignee: Kyocera Document Solutions Inc., Osaka-shi ( * ) Notice: Subject to any disclaimer, the term of this patent is extended or adjusted under 35 U.S.C. 154(b) by 0 days.

(21) Appl. No.: 13/596,995

(22) Filed: Aug. 28, 2012

(65) Prior Publication Data

US 2013/0053230 A1 Feb. 28, 2013

(30) Foreign Application Priority Data

Aug. 31, 2011 (JP) ..... 2011-188588

(51) Int. Cl.
*B31F 7/00* (2006.01)
*B65H 37/04* (2006.01)
*B65H 45/18* (2006.01)

(52) U.S. Cl.
CPC ..... *B65H 45/18* (2013.01); *B65H 2801/27* (2013.01); *B65H 37/04* (2013.01)
USPC ..... 493/421; 493/19; 493/23; 493/419

(58) Field of Classification Search
USPC ..... 493/14, 19, 23, 34, 427, 421, 425, 419
See application file for complete search history.

(56) References Cited

U.S. PATENT DOCUMENTS 6,440,049 B1 * 8/2002 Belanger et al. ..... 493/14
6,689,032 B2 * 2/2004 Mobius et al. ..... 493/23
6,746,390 B2 * 6/2004 Tamura et al. ..... 493/445
7,247,130 B2 * 7/2007 Mattila et al. ..... 493/421
7,326,161 B2 * 2/2008 Ishikawa ..... 493/25
7,503,886 B2 * 3/2009 Sekine et al. ..... 493/434
7,621,862 B2 * 11/2009 Neubauer et al. ..... 493/421
7,794,381 B2 * 9/2010 Yamamoto et al. ..... 493/421
2004/0214708 A1 * 10/2004 Krieger et al. ..... 493/419
2007/0045919 A1 3/2007 Hayashi
2009/0275456 A1 * 11/2009 Neubauer et al. ..... 493/421
2011/0278782 A1 * 11/2011 Watanabe et al. ..... 270/1.01
2013/0001848 A1 * 1/2013 Hidaka et al. ..... 270/58.17
2013/0001849 A1 * 1/2013 Suzuki et al. ..... 270/58.27
2013/0087965 A1 * 4/2013 Shimizu ..... 270/45

FOREIGN PATENT DOCUMENTS

EP 2316768 A1 5/2011
JP 2003-238026 A 8/2003

OTHER PUBLICATIONS

EESR issued to EP Application No. 12182093.0, mailed Dec. 14, 2012.

* cited by examiner

*Primary Examiner* — Thanh Truong
*Assistant Examiner* — Eyamindae Jallow
(74) *Attorney, Agent, or Firm* — Knobbe Martens Olson & Bear LLP

(57) ABSTRACT

The folding device includes a folding unit and a prior moving unit. The folding unit performs the folding process on the paper aligned by the alignment member positioned at the folding position. The prior moving unit moves the alignment member from the folding position to the home position or the alignment position according to a position of the end of the paper being moved in the folding process. This can put ahead the starting time for moving the alignment members and reduce the time required for a subsequent folding process, thereby improving efficiency (productivity) of the folding process as a whole.

1 Claim, 8 Drawing Sheets

FOLDING DEVICE AND SHEET FOLDING METHOD

REFERENCE TO RELATED APPLICATIONS

This application is based upon and claims the benefit of priority from the corresponding Japanese Patent Application No. 2011-188588, filed in the Japan Patent Office on Aug. 31, 2011, the entire contents of which are incorporated herein by reference.

BACKGROUND

The present disclosure relates to a folding device and a sheet folding method that can improve efficiency (productivity) of a folding process.

Conventionally, a folding device is provided in a sheet post-processing device attached to an image forming apparatus such as a multifunction peripheral. The sheet post-processing device prepares a magazine-like booklet by placing sheets such as paper on a tray into a stack, binding the stack of paper in a central portion thereof in a conveyance direction by a sheet binding device, and folding the stack of paper at the central portion thereof. The operation of binding and folding a stack of paper is referred to as "saddle stitch binding".

The folding device folds the paper by means of a sheet folding rotator pair. Folding with the sheet folding rotator pair has a limitation in folding performance and a drawback of noise generated by folding of the paper. Given this, the conveying speed of the paper is set to be constant during a period between the beginning of folding of the paper by the sheet folding rotator pair and release of the paper from the sheet folding rotator pair. As a result, productivity of the folding device cannot be improved. Similarly, productivity of sheet processing cannot be improved in a sheet post-processing device and an image forming apparatus provided with such a folding device.

In order to address such a problem, the sheet folding rotator pair can be separated after folding the paper. However, in such a case, the apparatus may be larger and more complex, leading to another problem of a higher cost.

As a technique for solving such a problem, a folding device including a pushing member, a folding rotator pair, a folding driving unit, and a control unit has been disclosed. The pushing member pushes an intermediate portion of the paper in a thickness direction. The folding rotator pair folds the paper while rotating and conveying. The folding driving unit rotates the folding rotator pair. The control unit controls the rotation speed of the folding driving unit. When the folding rotator pair folds and conveys a predetermined amount of paper, the control unit of the folding device controls the folding driving unit to accelerate the conveying speed of the paper by the folding rotator pair. As a result, the productivity can be improved while maintaining a folding quality of the paper.

In the abovementioned folding device, upon the folding process, an alignment member (also referred to as a reception member) for receiving an end of the sheet (paper) subjected to the folding process is disposed at a predetermined folding position. Upon completion of the folding process, the alignment member is moved to a predetermined home position (also referred to as an initial position).

Here, when the folding process is performed, the end of the paper is separated from the alignment member. Therefore, the alignment member serves for nothing during the folding process. On the other hand, since the alignment member does not start moving until completion of the folding process, moving of the alignment member is suspended for no reason and the time required for the folding process increases. The above-described technique cannot solve this problem.

SUMMARY

A folding device is supposed to comprise: an alignment member moving unit including an alignment member for aligning an end of paper, the alignment member moving unit moving the alignment member from a home position to a predetermined alignment position upon conveyance of the paper subjected to a folding process from an image forming apparatus and moving the alignment member from the alignment position to a predetermined folding position upon performing the folding process on the paper, and the following configuration is employed.

The folding device includes a folding unit and a prior moving unit. The folding unit performs the folding process on the paper aligned by the alignment member positioned at the folding position. The prior moving unit moves the alignment member from the folding position to the home position or the alignment position according to a position of the end of the paper being moved in the folding process.

DETAILED DESCRIPTION

An embodiment of an image forming apparatus provided with a finisher including the folding device of the present disclosure is described hereinafter with reference to the accompanying drawing. It should be noted that the following embodiments are mere examples of implementation of the present disclosure, and in no way restrict the technical scope of the present disclosure. As used herein, an alphabetical letter "S" prefixed to a number in the flowcharts represents a step.

Image Forming Apparatus and Finisher

Figure 1:
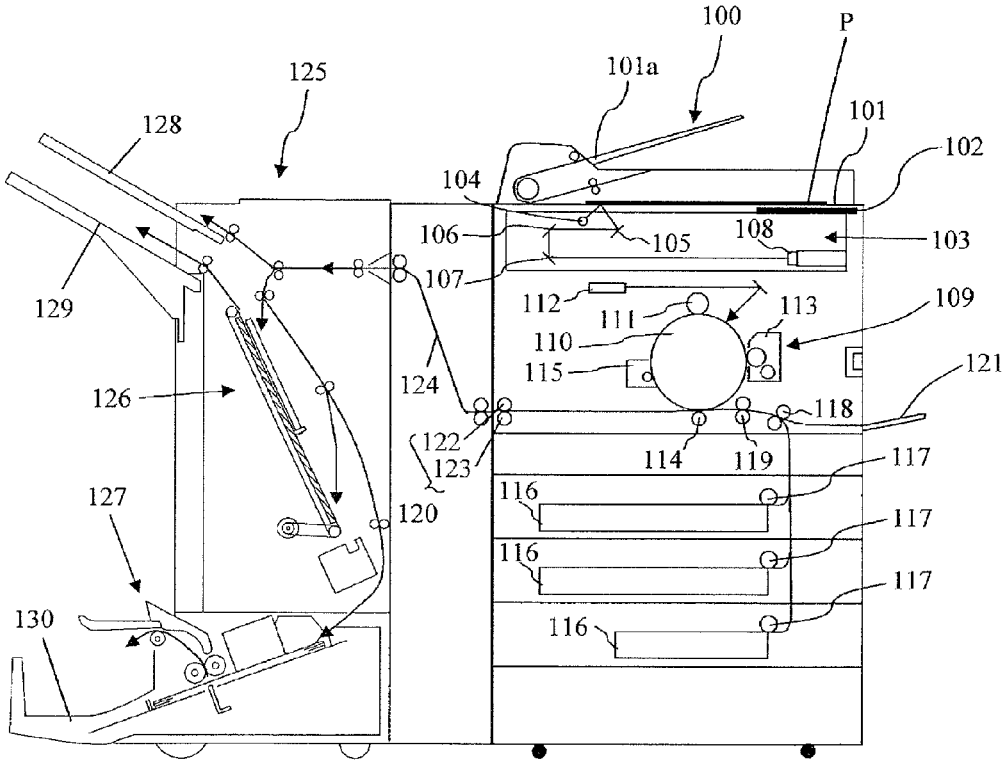
FIG. 1 is a schematic view of an image forming apparatus provided with a finisher including a folding device according to an embodiment of the present disclosure.

FIG. 1 is a schematic view of an image forming apparatus provided with the finisher including the folding device. However, the details of each component not directly related to the present disclosure are omitted.

The image forming apparatus provided with the folding device includes, for example, a printer or a scanner alone, or a multifunction peripheral provided with a printer, a copying machine, a scanner, a facsimile, and the like. The image forming apparatus functions as an image forming apparatus providing a copy service, a scanner service, a facsimile service, a printer service and the like. As an example, operation of a multifunction peripheral (MFP) 100 in a case of using a copy service is briefly described hereinafter.

First, when using the multifunction peripheral 100, the user places an original P on a platen 101 provided at a top face of the multifunction peripheral 100, and inputs settings of a copy function from an operation unit 102. Here, in a case there is a plurality of originals P, the plurality of originals can be placed on an automatic document feeder 101*a* provided at the top face of the multifunction peripheral 100. In the operation unit 102, an operation window (initial window or the like) related to the copy function provided by the multifunction peripheral 100 is displayed. The operation unit 102 selectably displays a plurality of setting item keys related to the copy function. In the operation window, function item keys for various functions are selectable displayed in tabs. A user inputs a setting condition relating to the copy function from the operation window.

After completing the input of the setting condition, the user makes the multifunction peripheral 100 start the process of the copy function by pressing a start key provided in the operation unit 102.

When the multifunction peripheral 100 starts processing the copy function, in an image reading unit 103, a light emitted from a light source 104 is reflected in the original P placed on the platen 101. The light thus reflected is guided by the mirrors 105, 106, 107 to an imaging device 108. The light thus guided is photoelectrically converted to an electrical signal by the imaging device 108. The electrical signal is subjected to basic correction processing, image quality processing, compression processing and the like, to thereby generate image data corresponding to the original.

In a case in which a plurality of originals is placed on the automatic document feeder 101*a*, the light source 104 is moved to a position at which a light can be reflected by a part of the original conveyed by the automatic document feeder 101*a*. Each of the originals conveyed one by one is irradiated with a light, to thereby generate image data.

The image forming unit 109 is a driving unit that transfers the image data as a toner image. The above image forming unit 109 is provided with a photo conductor drum 110. The photo conductor drum 110 rotates in a predetermined direction at a constant speed. In the periphery of the photoreceptor drum 110, a charging device 111, an exposure unit 112, a developing device 113, a transfer device 114, a cleaning unit 115 and the like are disposed, in this order from an upstream side in a rotational direction.

The charging device 111 uniformly charges a surface of the photoreceptor drum 110. The exposure unit 112 irradiates a surface of the photoreceptor drum 110 thus charged with laser based on the image data, thereby forming an electrostatic latent image. The developing device 113 deposits toner on the electrostatic latent image being conveyed, to thereby form a toner image. The toner image thus formed is transferred to a recording medium (for example, a sheet such as paper) by the transfer device 114. The cleaning unit 115 removes excessive toner remaining on the surface of the photoreceptor drum 110. This series of processes is performed by rotation of the photoreceptor drum 110.

The paper is fed from a plurality of paper feeding cassettes 116 provided in the multifunction peripheral 100. The paper to be fed is pulled out from any one of the paper feeding cassettes 116 to a paper path by a pickup roller 117. In each of the paper feeding cassettes 116, paper of different types are stored. The paper is fed according to a setting relating to the output condition.

The paper being pulled out to the paper path is fed into between the photoreceptor drum 110 and the transfer device 114 by a feeding roller 118 and a resist roller 119. The sheet thus fed is, after transfer of the toner image thereto by the transfer device 114, further fed to the fusing device 120. The paper fed by the feeding roller 118 may also be fed from a manual feeding tray 121 provided in the multifunction peripheral 100.

When the paper to which the toner image is transferred passes between a heating roller 122 and a pressurizing roller 123 provided in the fusing device 120, heat and pressure are applied to the toner image, thereby fusing a visible image onto the paper. Heat quantity of the heating roller 122 is optimized according to types of sheets, in order to appropriately realize the fusing. The image formation is completed with fusing of the visible image onto the paper. The paper onto which the visible image is fused is conveyed to the finisher 125 (post-processing device) via the fusing device 120 and a predetermined paper path 124.

The finisher 125 includes a stapling device 126 and a folding device 127. The paper fed to the finisher 125 is either: ejected to a sub tray 128; conveyed to the stapling device 126; or conveyed to the folding device 127, according to the setting condition input by a user.

The paper conveyed to the stapling device 126 is subjected to stapling according to the setting condition and then ejected to a main tray 129. On the other hand, the paper conveyed to the folding device 127 is subjected to a folding process according to the setting condition and then ejected to a folding tray 130.

By the above described steps, the multifunction peripheral 100 provides the copy function to a user. In addition, the multifunction peripheral 100 performs a stapling process and a folding process, as necessary, on the paper on which an image is formed.

Figure 2:
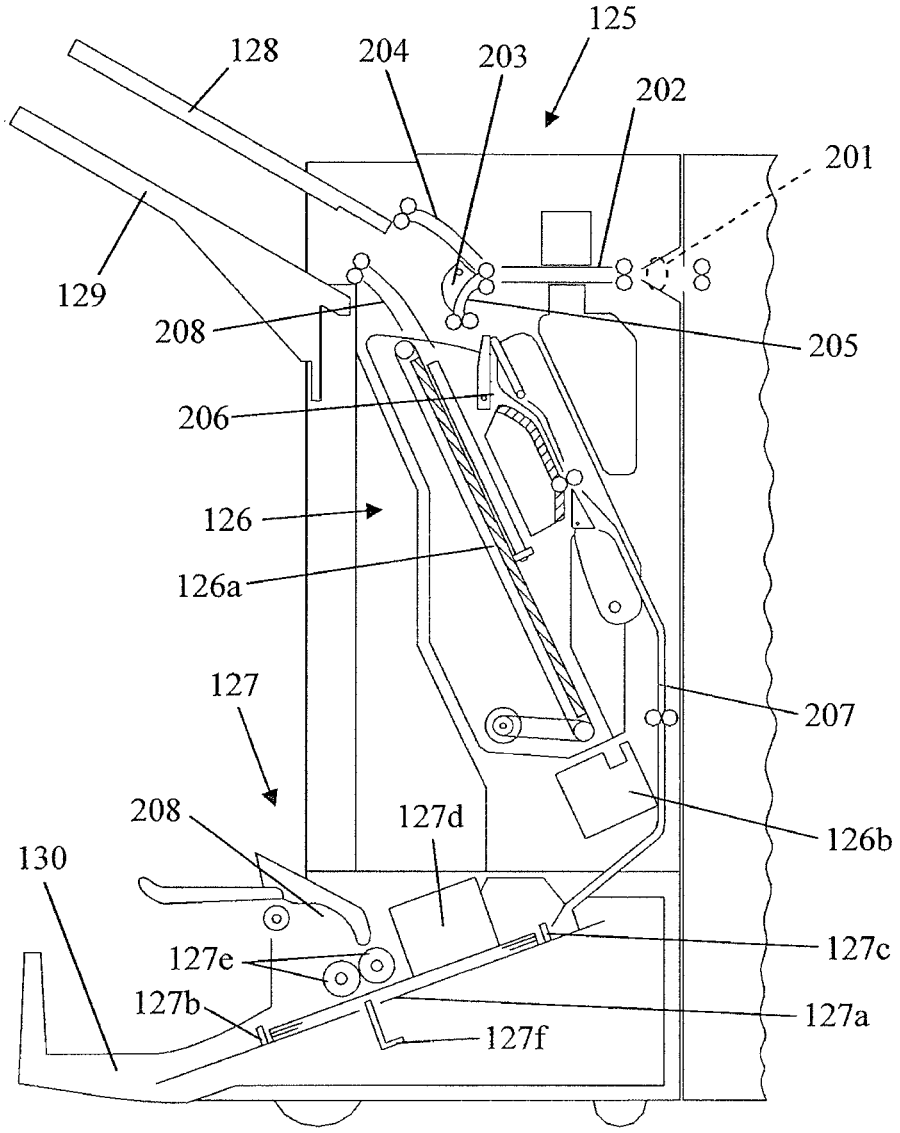
FIG. 2 is a front cross-sectional view of an image forming apparatus provided with the finisher including the folding device according to the embodiment of the present disclosure.

FIG. 2 is a front cross-sectional view of an image forming apparatus provided with the finisher including the folding device.

When the paper, on which an image is formed in the multifunction peripheral 100, passes through a paper inlet 201 and an inlet side paper path 202 of the finisher 125, the paper is guided either toward a sub tray paper path 204 extending to the sub tray 128 or toward a post-processing paper path 205 extending to the stapling device 126 or the folding device 127, by a switching guide 203 provided on a downstream end of the inlet side paper path 202. In a case in which no post-processing is required for the paper, the paper is guided to the sub tray paper path 204 by the switching guide 203 and directly ejected to the sub tray 128.

On the other hand, in a case in which a predetermined post-processing condition is included in the setting condition, the paper is guided to the post-processing paper path 205 by the switching guide 203. And then the paper is guided either toward a stapling paper path 206 extending to the stapling device 126 or toward a folding paper path 207 extending to the folding device 127, according to a type of the post-processing condition (stapling process, folding process and the like).

When the paper is guided toward the stapling paper path 206, a predetermined number of sheets of the paper are stacked on the paper mount 126*a* of the stapling device 126, thereby forming a stack of paper on the paper mount 126*a*. A downward end of the stack of the paper thus formed is positioned at an end-binding stapler 126*b* where the end of the stack of the paper is stapled. After the stapling, the stack of the paper is ejected to the main tray 129 via a main tray paper path 208.

On the other hand, when the paper is guided toward the folding paper path 207, the paper is brought to a paper mount 127*a* of the folding device 127 that is at a predetermined angle with respect to a horizontal direction (ground). On a downstream side of the paper mount 127*a*, a downstream alignment member 127*b* is provided that receives a downstream end of the paper conveyed from the folding paper path 207. On an upstream side of the paper mount 127*a*, an upstream alignment member 127*c* is provided that is brought into contact with an upstream end of the paper. The downstream alignment member 127*b* and the upstream alignment member 127*c* can move independently from each other, along a top face of the paper mount 127*a*. Same as the above, a predetermined number of sheets of the paper is stacked on the paper mount 127*a*, thereby forming a stack of paper on the paper mount 127*a*.

A center-binding stapler 127*d* is provided in advance above the paper mount 127*a* of the folding device 127. Here, the downstream alignment member 127*b* and the upstream alignment member 127*c* in a state of aligning the stack of the paper move along the top face of the paper mount 127*a*. As a result, a processing unit of the center-binding stapler 127*d* is positioned above the central portion of the stack of the paper.

Movement of the downstream alignment member 127*b* and the upstream alignment member 127*c* is adjusted by detecting a predetermined position on the downstream alignment member 127*b* and a predetermined position on the upstream alignment member 127*c* by a plurality of detection sensors (not illustrated; described later) provided in advance at predetermined positions. The center-binding stapler 127*d* may be or may not be activated according to a setting of the post-processing condition. When the center-binding stapler 127*d* is activated, the central portion of the stack of the paper is stapled.

In the left vicinity of the center-binding stapler 127*d*, a folding roller pair 127*e* is provided in advance. In addition, at a position facing the folding roller pair 127*e* across the paper mount 127*a*, a folding blade 127*f* is provided. As described above, the downstream alignment member 127*b* and the upstream alignment member 127*c* in a state of aligning the stack of the paper moves along the top face of the paper mount 127*a*. As a result, a position on the upper side of the central portion of the stack of the paper is positioned between the folding roller pair 127*e* and a position on the lower side of the central portion of the stack of the paper is positioned on the folding blade 127*f*.

Movement of the downstream alignment member 127*b* and the upstream alignment member 127*c* is adjusted by, as described above, providing the plurality of detection sensors (not illustrated; described later) at predetermined positions in advance at which the downstream alignment member 127*b* and the upstream alignment member 127*c* are to be positioned.

The folding blade 127*f* pushes up the central portion of the stack of the paper and the folding roller pair 127*e* rotates in a synchronized manner at a predetermined nip pressure, to thereby make a fold in the central portion of the stack of the paper thus the folding process is performed.

A first folding roller of the folding roller pair 127*e* is elastically biased toward a second folding roller by a spring (not illustrated), to thereby apply the predetermined nip pressure to the stack of the paper.

Furthermore, as the folding roller pair 127*e* continues rotating, the stack of the paper thus folded is guided toward a folding tray paper path 208 extending to the folding tray 130 and then ejected to the folding tray 130.

Figure 3:
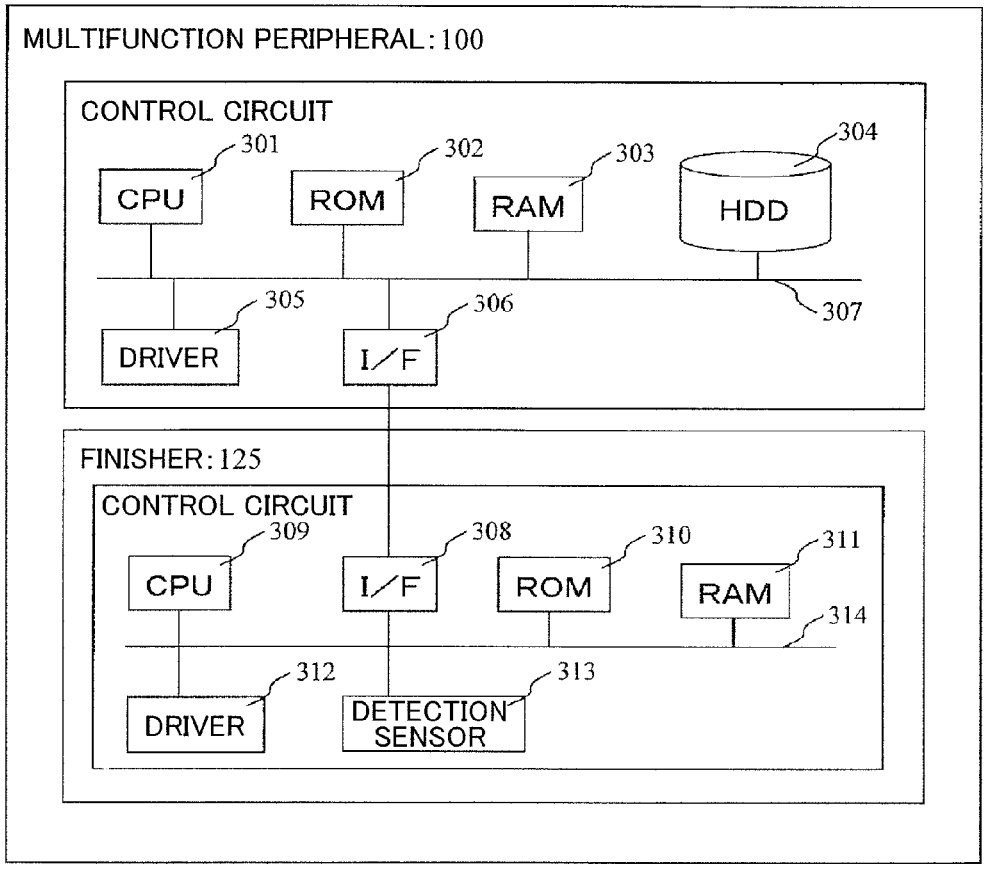
FIG. 3 is a schematic configuration diagram of control hardware for a multifunction peripheral and the finisher including the folding device according to the embodiment of the present disclosure.

Next, a hardware configuration of control hardware of the multifunction peripheral 100 and the finisher 125 is described with reference to FIG. 3. FIG. 3 is a schematic configuration diagram of control hardware for a multifunction peripheral and the finisher 125 including the folding device 127 according to the present disclosure. However, the details of each component not directly related to the present disclosure are omitted.

A control circuit of the multifunction peripheral 100 is configured such that a CPU (Central Processing Unit) 301, ROM (Read Only Memory) 302, RAM (Random Access Memory) 303, a HDD (Hard Disk Drive) 304, drivers 305 respectively corresponding to the driving units, and an internal interface 306 are connected via an internal bus 307.

The CPU 301 uses the RAM 303 as workspace, for example, and executes programs stored in the ROM 302, the HDD 304 and the like. The CPU 301 receives data and the like from the driver 305 based on a result of the execution, and controls operation of the driving units shown in FIG. 1.

In addition, the internal interface 306 connects the control circuit of the finisher 125 and the control circuit of the multifunction peripheral 100, via an internal interface 308 of the control circuit of the finisher 125.

In the control circuit of the finisher 125, a CPU 309, ROM 310, RAM 311, a driver 312 corresponding to each driving unit, a predetermined number of detection sensors 313, and the internal interface 308 are connected by an internal bus 314. The CPU 309 receives an instruction signal from the CPU 301 of the multifunction peripheral 100 and executes a program stored in the ROM 310 and the like, by using the RAM 311 as workspace. In addition, the CPU 309 receives data and the like from the driver 312 and the detection sensor 313 based on a result of the execution, and controls operation of the driving units shown in FIGS. 1 and 2.

In addition, each unit (illustrated in FIG. 4) described hereafter other than the abovementioned driving units is operated by execution of programs by the CPUs 301 and 309. Programs and data for realizing the units described below are recorded in the ROM 302 310, the HDD 304, and the like.

EMBODIMENT OF THE PRESENT DISCLOSURE

Figure 4:
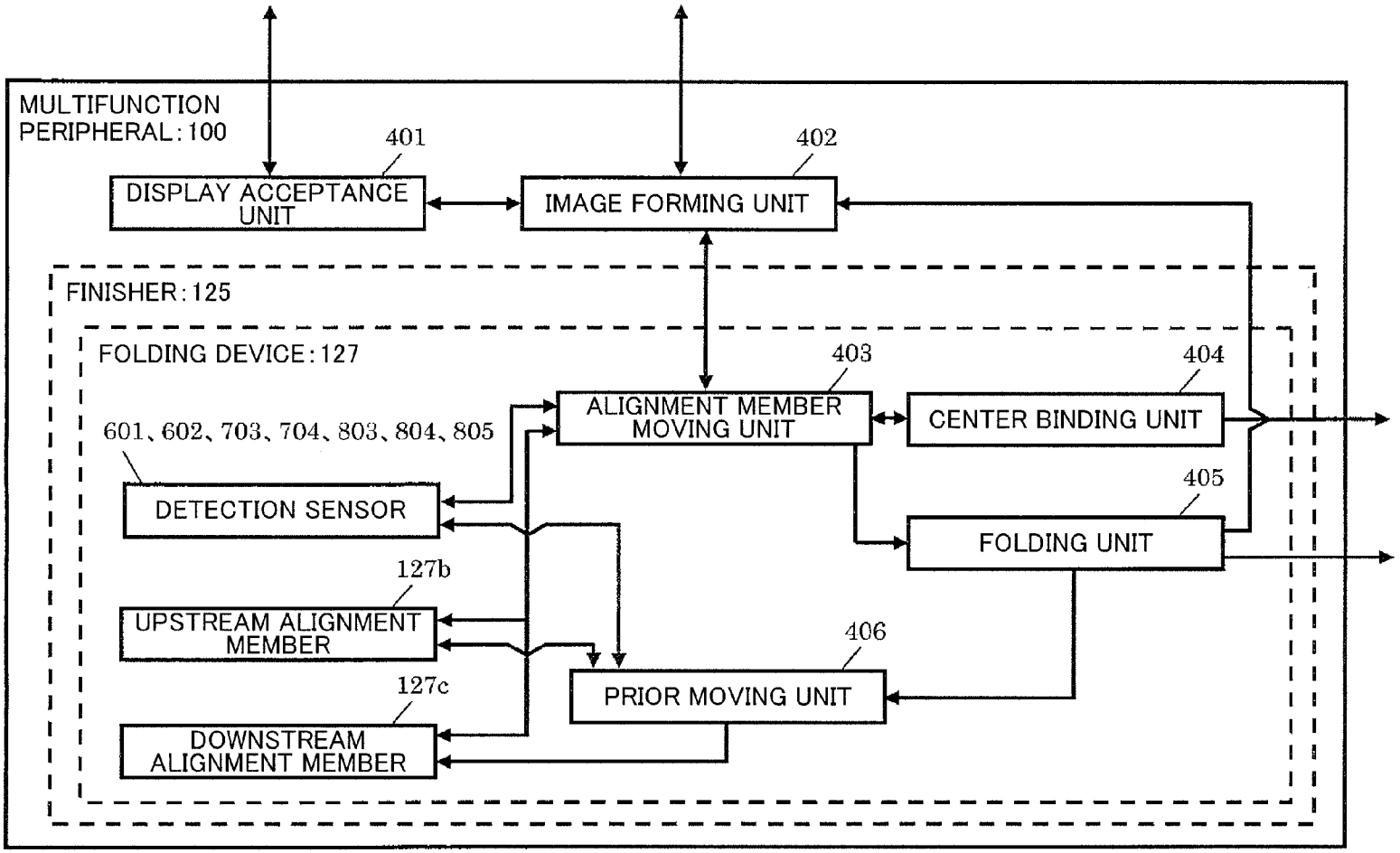
FIG. 4 is a functional block diagram of the multifunction peripheral and the finisher including the folding device according to the embodiment of the present disclosure.
Figure 5:
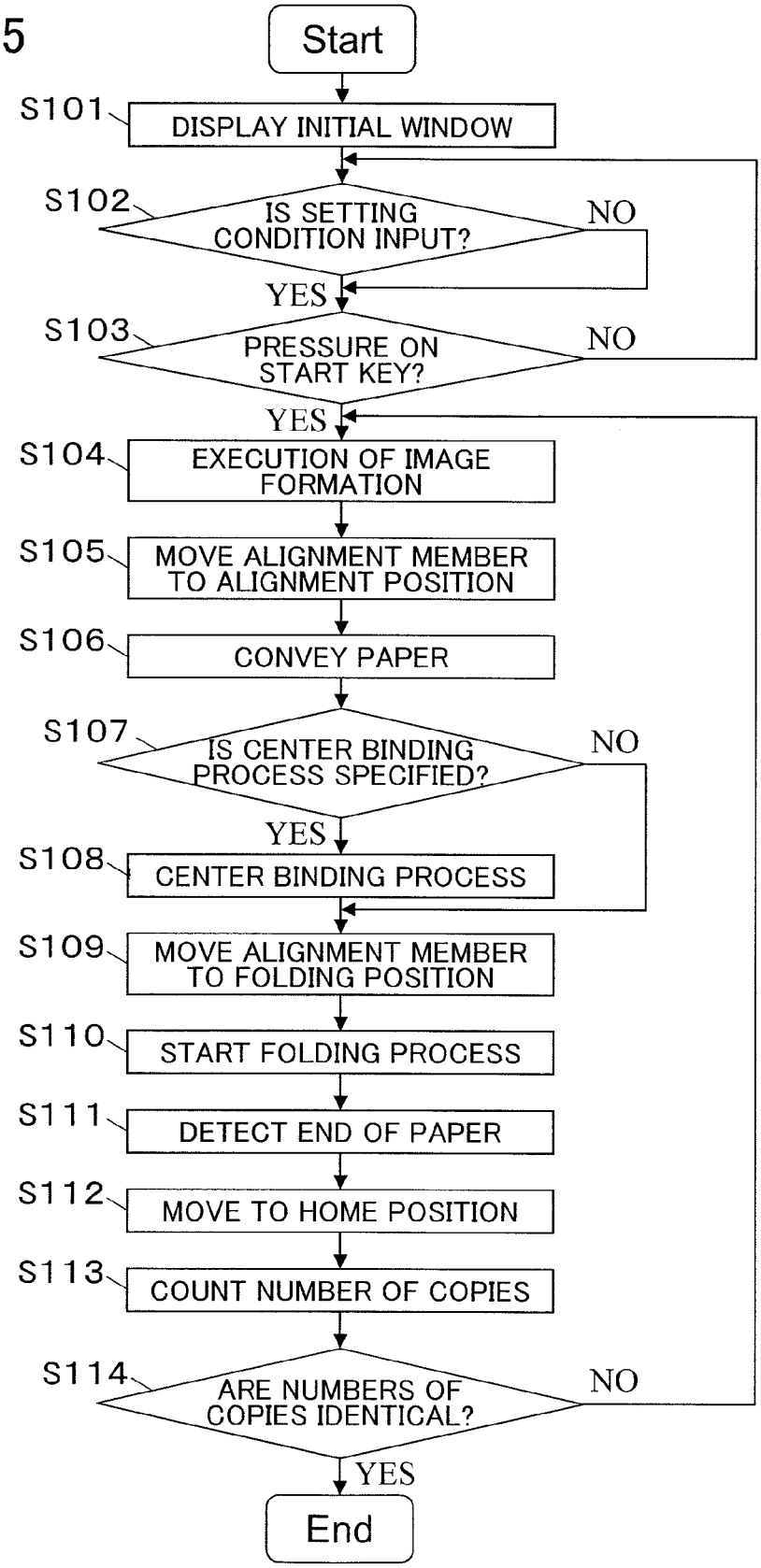
FIG. 5 is a flowchart showing an execution procedure of the embodiment of the present disclosure.

Next, a configuration and execution procedure (folding method) according to the embodiment of the present disclosure will be described with reference to FIGS. 4 and 5. FIG. 4 is a functional block diagram of the multifunction peripheral and the finisher including the folding device of the present disclosure. FIG. 5 is a flowchart showing the execution procedure of the present disclosure.

First, when a user turns on the multifunction peripheral 100 with the finisher 125 attached thereto, the multifunction peripheral 100 and the finisher 125 are activated. The display acceptance unit 401 of the multifunction peripheral 100 displays a predetermined operation window (initial window) and accepts input of setting conditions relating to a copy function (FIG. 5: S101).

Here, the user places a plurality of sheets (for example, 3 sheets) of original on the automatic document feeder 101*a* and inputs folding conditions corresponding to the center binding process and the center folding process and the number of copies (for example, 3 copies) as the setting conditions (FIG. 5: S102YES). When the user presses a START key (FIG. 5: S103YES), the display acceptance unit 401 accepts the setting conditions and pressure on the START key and notifies the image forming unit 402 of the setting conditions and the pressure. In response to the notification, the image forming unit 402 starts execution of image formation according to the setting conditions (FIG. 5: S104).

In a case in which the user presses the START key without inputting the setting conditions, the display acceptance unit 401 accepts initial setting conditions (for example, "no folding", "1 copy" and the like) that are defined in advance in the multifunction peripheral 100, as the setting conditions. The image forming unit 402 thus executes image formation based on the initial setting conditions.

Here, if the setting conditions include a folding condition, the image forming unit 402 notifies an alignment member moving unit 403 in the folding device 127 in the finisher 125 of the folding condition. In response to the notification, the alignment member moving unit 403 moves the downstream alignment member 127*b* provided on a downstream side of the paper mount 127*a* of the folding device 127 and the upstream alignment member 127*c* provided on an upstream side of the paper mount 127*a*, from predetermined home positions (initial positions) to predetermined alignment positions (FIG. 5: S105).

Figure 6A:
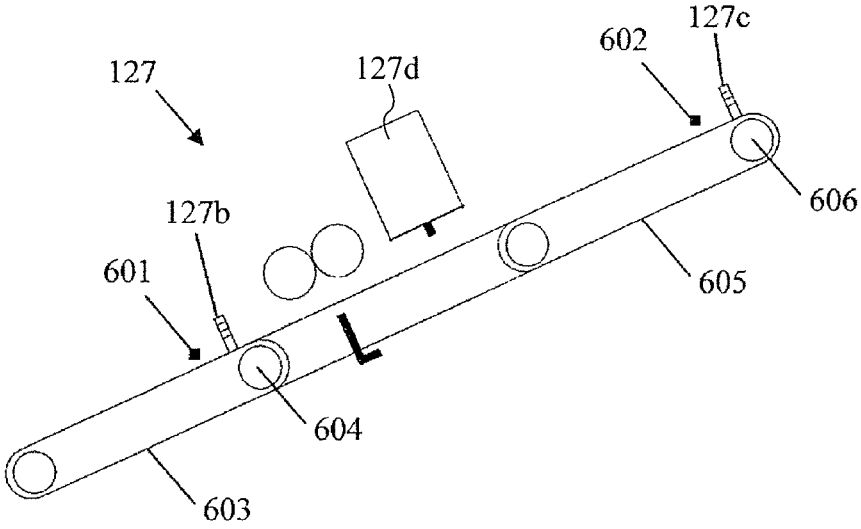
FIG. 6A is a first diagram illustrating an example of operation by the folding device according to the embodiment of the present disclosure.
Figure 6B:
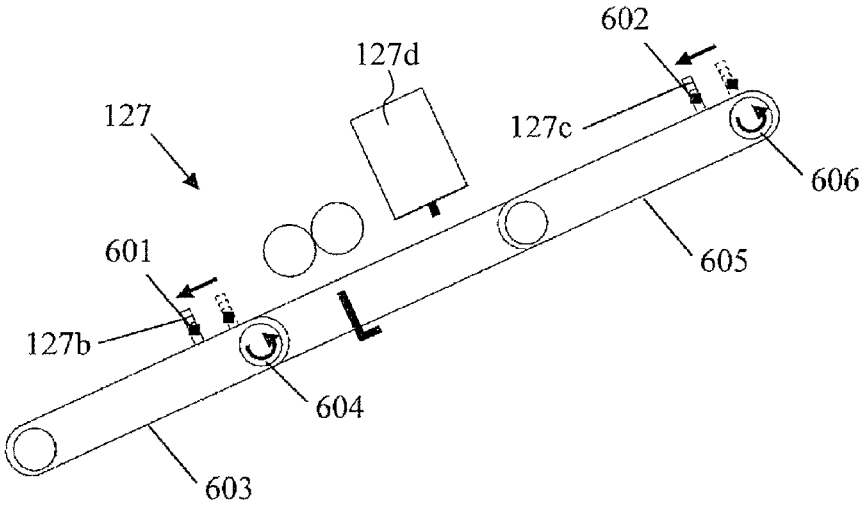
FIG. 6B is a second diagram illustrating an example of operation by the folding device according to the embodiment of the present disclosure.

The alignment member moving unit 403 can move the downstream alignment member 127*b* and the upstream alignment member 127*c* to the alignment positions in any way. For example, as shown in FIG. 6A, the first detection sensor 601 and the second detection sensor 602 for respectively detecting the presence of the downstream alignment member 127*b* and the upstream alignment member 127*c* are arranged respectively at a downstream alignment position corresponding to the downstream alignment member 127*b* and an upstream alignment position corresponding to the upstream alignment member 127*c*. Next, the alignment member moving unit 403 monitors the first detection sensor 601 and the second detection sensor 602, and, as shown in FIG. 6B, moves the downstream alignment member 127*b* and the upstream alignment member 127*c* along the top face of the paper mount 127*a*. In a case in which the downstream alignment member 127*b* is detected by the first detection sensor 601, the alignment member moving unit 403 stop moving the downstream alignment member 127*b*. In a case in which the upstream alignment member 127*c* is detected by the second detection sensor 602, the alignment member moving unit 403 stop moving the upstream alignment member 127*c*.

Here, movement of the downstream alignment member 127*b* and the upstream alignment member 127*c* is controlled as follows. In other words, as shown in FIGS. 6A and 6B, the downstream alignment member 127*b* is formed integrally with a downstream endless belt 603 that is arranged on a downstream side of the paper mount 127*a*. The alignment member moving unit 403 rotates a downstream driving pulley 604 holding the downstream endless belt 603 such that the downstream alignment member 127*b* moves toward the downstream alignment position, while monitoring the first detection sensor 601 corresponding to the downstream alignment position. When the first detection sensor 601 detects the downstream alignment member 127*b*, the alignment member moving unit 403 stops rotation of the downstream driving pulley 604. The same applies to the upstream alignment member 127*c*. The upstream alignment member 127*c* is formed integrally with an upstream endless belt 605 that is arranged on an upstream side of the paper mount 127*a*. By rotating the upstream endless belt 605 by the upstream driving pulley 606, the upstream alignment member 127*c* is moved to the upstream alignment position where the second detection sensor 602 is disposed.

Once the alignment member moving unit 403 moves the downstream alignment member 127*b* to the downstream alignment position and the upstream alignment member 127*c* to the upstream alignment position, the alignment members 127*b*, 127*c* are ready to accept the paper on which an image is formed. Here, the alignment member moving unit 403 notifies the image forming unit 402. In response to the notification, the image forming unit 402 performs image formation on the paper based on image data corresponding to the number of sheets (three) of the original according to the setting conditions, and then conveys the paper on which an image is formed toward the paper mount 127*a* of the folding device 127 one by one, via the paper path of the finisher 125 (FIG. 5: S106).

Figure 7A:
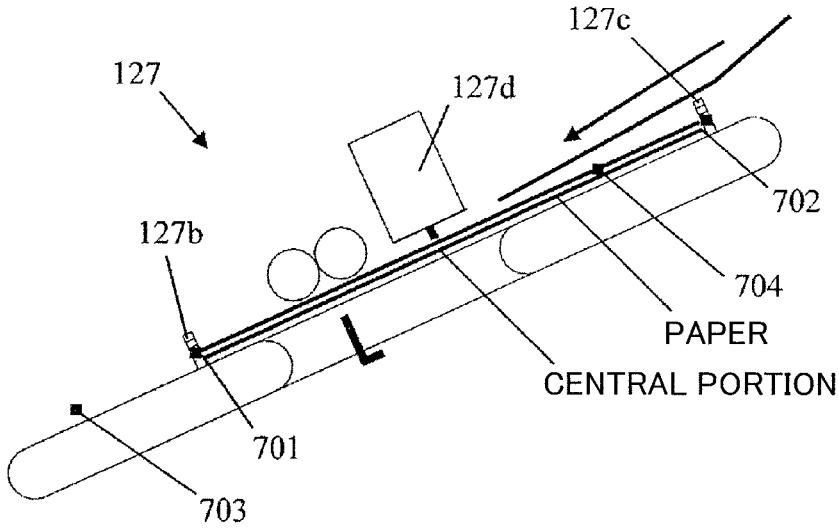
FIG. 7A is a first diagram illustrating an example of operation by the folding device according to the embodiment of the present disclosure.

Here, a downstream end of the paper conveyed to the paper mount 127*a* is in contact with the downstream alignment member 127*b* that has been moved to the downstream alignment position, as shown in FIG. 7A. The downstream end of the paper is substantially aligned. In addition, since the paper mount 127*a* is inclined, the paper is inevitably positioned between the downstream alignment member 127*b* and the upstream alignment member 127*c*. In this state, by shaking the upstream alignment member 127*c* to tap an upstream end of the paper, width alignment and skew compensation can be performed on the stack of the paper, which is a plurality of sheets of paper being conveyed to the paper mount 127*a*.

A distance between the downstream alignment member 127*b* and the upstream alignment member 127*c* is defined by a paper size specified by a user or a paper size in the initial setting conditions.

When the image forming unit 402 completes conveyance of the plurality of sheets of paper on which images are formed to the paper mount 127*a* of the folding device 127, the image forming unit 402 notifies a center binding unit 404. In response to the notification, according to the setting condition (FIG. 5: S107), the center binding unit 404 performs (FIG. 5: S107YES to S108) or does not perform (FIG. 5: S107NO) center binding in a central portion of the stack of paper in the conveyance direction.

Here, as shown in FIG. 7A, if a downstream end 701 of the stack of paper is in contact with the downstream alignment member 127*b* at the downstream alignment position and an upstream end 702 of the stack of paper is in contact with the upstream alignment member 127*c* at the upstream alignment position, a processing unit of the center-binding stapler 127*d* provided above the paper mount 127*a* is positioned directly above the central portion of the stack of paper in the conveyance direction. The downstream alignment position and the upstream alignment position are thus configured. Given this, in a case in which the setting conditions include the center binding, the center-binding is realized in the central portion of the stack of paper in the conveyance direction by the center-binding unit 404 lowering the processing unit of the center-binding stapler 127*d* thus positioned (FIG. 5: S108). Once the center-binding is completed, the processing unit of the center-binding stapler 127 is moved up again.

On the other hand, in a case in which the setting conditions do not include the center binding, the center-binding unit 404 skips the center-binding.

When the center-binding unit 404 finishes the center binding, the center-binding unit 404 notifies the alignment member moving unit 403. In response to the notification, the alignment member moving unit 403 moves the downstream alignment member 127*b* and the upstream alignment member 127*c* respectively to predetermined folding positions (FIG. 5: S109).

Here, the alignment member moving unit 403 can move the downstream alignment member 127*b* and the upstream alignment member 127*c* to the folding positions in the same way as above. In the alignment member moving unit 403, as shown in FIG. 7A, the third detection sensor 703 and the fourth detection sensor 704 are arranged respectively at a downstream folding position corresponding to the downstream alignment member 127*b* and an upstream folding position corresponding to the upstream alignment member 127*c*. The alignment member moving unit 403 moves the alignment members 127*b* and 127*c* respectively along the upper face of the paper mount 127*a*, until the detection sensors 703, 704 detect the alignment members 127*b* and 127*c*.

In a case of moving the downstream alignment member 127*b* and the upstream alignment member 127*c* to the folding positions respectively, since the stack of paper is positioned between the downstream alignment member 127*b* and the upstream alignment member 127*c*, the stack of paper is moved according to movement of the alignment members 127*b* and 127*c*.

Figure 7B:
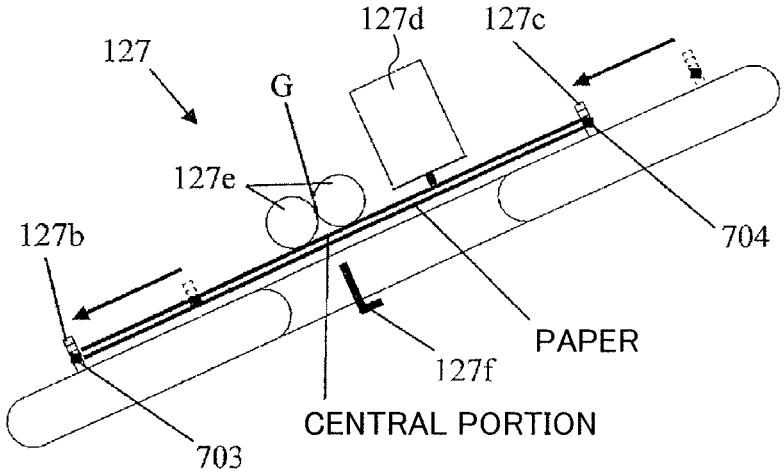
FIG. 7B is a second diagram illustrating an example of operation by the folding device according to the embodiment of the present disclosure.

As shown in FIG. 7B, the alignment member moving unit 403 moves the downstream alignment member 127*b* to the downstream folding position and the upstream alignment member 127*c* to the upstream folding position. Thereafter, the alignment member moving unit 403 notifies the folding unit 405. In response to the notification, the folding unit 405 performs the folding process on the stack of paper positioned between the downstream alignment member 127*b* and the upstream alignment member 127*c* (FIG. 5: S110).

Here, as shown in FIG. 7B, the downstream end 701 of the stack of paper is in contact with the downstream alignment member 127*b* at the downstream folding position and the upstream end 702 of the stack of paper is in contact with the upstream alignment member 127*c* at the upstream folding position. As a result, a nip portion G of the folding roller pair 127*e* provided above the paper mount 127*a* is positioned directly above the central portion of the stack of paper in the conveyance direction, and the folding blade 127*f* provided below the paper mount 127*a* is positioned directly below the central portion of the stack of paper in the conveyance direction. In response to the notification, the folding unit 405 immediately presses the folding blade 127*f* against the nip portion G of the folding roller pair 127*e* from below the paper mount 127*a* (pushing up), while rotating the folding roller pair 127*e*.

Figure 8A:
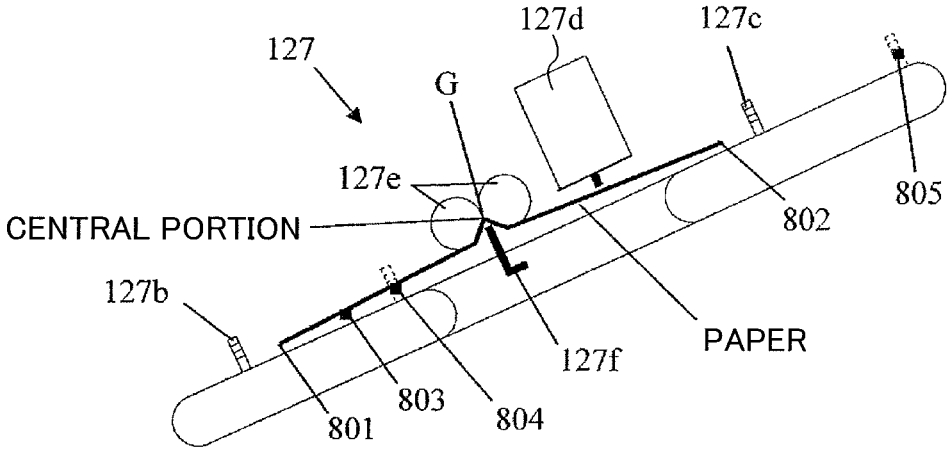
FIG. 8A is a first diagram illustrating an example of operation by the folding device according to the embodiment of the present disclosure.

As a result, as shown in FIG. 8A, the central portion of the stack of paper being pressed by the folding blade 127*f* is inserted into the nip portion G of the folding roller pair 127*e*, where the stack of paper is center-folded by rotation of the folding roller pair 127*e*.

Here, as the folding unit 405 starts the folding process, the folding unit 405 notifies the prior moving unit 406. In response to the notification, the prior moving unit 406 moves the alignment members 127*b*, 127*c* from the folding position to the home position according to a position of the end of the stack of paper moved in the folding process.

In other words, when the folding unit 405 performs the folding process on the stack of paper, the central portion of the stack of paper is inserted into between the folding roller pair 127*e*. As a result, as shown in FIG. 8A, a downstream end 801 of the stack of paper and an upstream end 802 of the stack of paper are spaced apart from the downstream alignment member 127*b* and the upstream alignment member 127*b* respectively, with which these ends have been in contact. The downstream alignment member 127*b* and the upstream alignment member 127*c* no longer need to be in contact with (aligns) the ends 801, 802 of the stack of paper. Given this, according to positions of the ends 801, 802 of the stack of paper, the prior moving unit 406 moves the downstream alignment member 127*b* and the upstream alignment member 127*c* back to the home position for a subsequent process (for example, a center-binding process and a folding process).

In prior arts, the alignment members 127*b* and 127*c* start moving to the home position after completion of the folding process. In the present disclosure, by starting moving the alignment members 127*b* and 127*c* to the home position during the folding process, the starting time for moving the alignment members 127*b* and 127*c* can be put ahead by a predetermined amount of time (for example, by several seconds to several dozen seconds). As a result, the amount of time required for preparation for a subsequent process can be reduced, leading to reduction in total time required for the folding process.

A method, by which the prior moving unit 406 moves the alignment members 127*b* and 127*c* from the folding position to the home position according to the positions of the ends 801, 802 of the stack of paper moved in the folding process, can be arbitrarily selected unless the alignment members 127*b* and 127*c* that are moved do not interfere (collide) with the ends 801, 802 of the stack of paper.

Figure 8B:
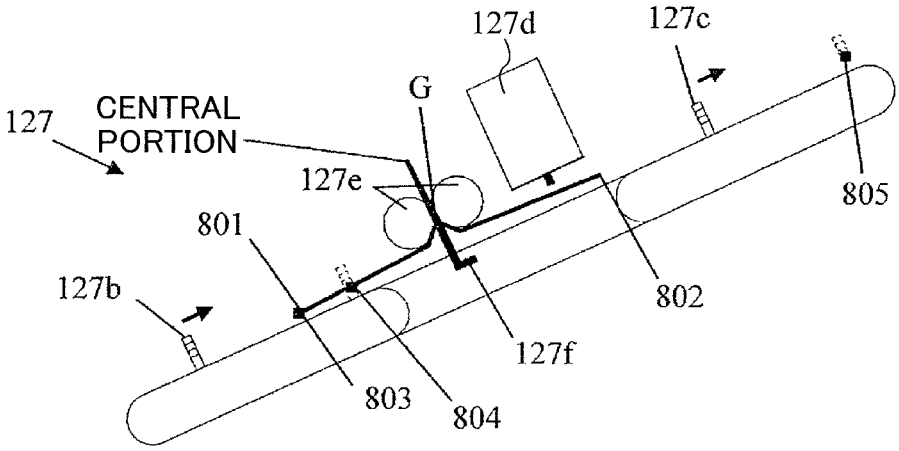
FIG. 8B is a second diagram illustrating an example of operation by the folding device according to the embodiment of the present disclosure.

For example, as shown in FIG. 8B, the downstream adjustment member 127*b*, which can interfere with the end of the stack of paper when the adjustment member is moved to the home position during the folding process, is handled as follows. A fifth detection sensor 803 for detecting the end 801 of the stack of paper is provided in advance. The fifth detection sensor 803 is provided at a predetermined position on a path of the downstream end 801 of the stack of paper that is moved in the folding process, for example, a predetermined position (hereinafter referred to as a moving starting position) between the downstream folding position of the downstream alignment member 127*b* and the downstream home position corresponding to the downstream alignment member 127*b*. Thereafter, when the fifth detection sensor 803 detects the downstream end 801 of the stack of paper (FIG. 5: S111) as shown in FIG. 8B, the prior moving unit 406 starts moving the downstream alignment member 127*b* to the home position (FIG. 5: S112).

As a result, moving of the downstream alignment member 127*b* can be started after that the downstream end 801 of the stack of paper is sufficiently spaced away from the downstream alignment member 127*b*. In addition, interference between the downstream alignment member 127*b* and the downstream end 801 can be prevented.

Moving speed of the downstream alignment member 127*b* moved by the prior moving unit 406 is changed appropriately according to: the downstream folding position of the downstream alignment member 127*b*; the downstream home position; a positional relationship of the moving starting position; a rotation speed of the folding roller pair 127*e*; a rotation speed of the downstream endless belt 604 of the downstream adjustment member 127*b*; and the like. On the other hand, a moving speed of the downstream alignment member 127*b* moved by the prior moving unit 406 is set to be lower than a moving speed of the end 801 of the paper moved in the folding process.

As a result, the downstream alignment member 127*b* does not reach the end 801 of the stack of paper even after moving. Interference between the downstream alignment member 127*b* and the end 801 of the stack of paper can thus be prevented.

The setting is made as follows. For example, a period of time A required for the downstream alignment member 127*b* moving from the downstream folding position to the downstream home position, and a period of time B required for the end 801 of the stack of paper moved in the folding process moving from the movement starting position to the downstream home position are measured in advance. And then, the moving speed of the downstream alignment member 127*b* is set such that the period of time A is longer than the period of time B.

As shown in FIG. 8A, the upstream adjustment member 127*c*, which is unlikely to interfere with the end of the stack of paper when the adjustment member is moved to the home position during the folding process, can be moved theoretically at any time.

For example, as shown in FIG. 8B, the prior moving unit 406 can start moving the upstream adjustment member 127*c* as it starts moving the downstream adjustment member 127*b*. Alternatively, the prior moving unit 406 can move only the upstream adjustment member 127*c* in advance from the upstream folding position to the upstream home position corresponding to the upstream adjustment member 127*c*, as the folding process starts.

The prior moving unit 406 moves the downstream adjustment member 127*b* and the upstream adjustment member 127*c* respectively to the downstream home position and the upstream home position in the same way as above. A sixth detection sensor 804 and a seventh detection sensor 805 are disposed at the downstream home position and the upstream home position respectively. The prior moving unit 406 moves the alignment members 127*b* and 127*c* respectively along the upper face of the paper mount 127*a*, until the detection sensors 804, 805 detect the alignment members 127*b* and 127*c*.

The stack of paper thus folded by the folding unit 405 is ejected to the folding tray 130 via the folding tray paper path 208. Upon completion of the folding process, the folding unit 405 notifies the image forming unit 402 of the completion of the folding process. In response to the notification, the image forming unit 402 counts the number of folded copies by incrementing an initial value (0 copy) by one (FIG. 5: S113), and determines whether the counted number of copies is identical to the number of copies in the setting condition (FIG. 5: S114).

In response to the notification, in a case in which the counted number of copies (1 copy) is not identical to the number of copies in the setting condition (3 copies) (FIG. 5: S114NO), the image forming unit 402 restart the execution of image formation (FIG. 5: S104). And then, the image forming unit 402 notifies the alignment member moving unit 403 and, in response to the notification, the alignment member moving unit 403 moves the downstream alignment member 127*b* and the upstream alignment member 127*c* respectively to the downstream alignment position and the upstream alignment position (FIG. 5: S105).

Here, the prior moving unit 406, having moved the alignment members 127*b* and 127*c* respectively to the home positions, can immediately start moving the downstream alignment member 127*b* to the downstream alignment position and the upstream alignment member 127*c* to the upstream alignment position.

After repetition of the image formation and the folding process, in a case in which the counted number of copies (3 copies) is identical to the number of copies in the setting condition (3 copies) (FIG. 5: S114YES), the image forming unit 402 terminates all the processes and notifies the display acceptance unit 401. In response to the notification, the display acceptance unit 401 displays the initial window again and accepts an input of new setting conditions from a user.

As described above, the folding device 127 of the finisher 125 according to the present disclosure includes the folding unit 405 and the prior moving unit 406. The folding unit 405 performs the folding process on the stack of paper aligned by the alignment members 127*b*, 127*c* positioned at the folding positions. The prior moving unit 406 moves the alignment members 127*b*, 127*c* from the folding positions to the home positions according to a position of the end of the stack of paper being moved in the folding process.

As a result, moving of the alignment members 127*b*, 127*c* to the home positions, that was conventionally started after completion of the folding process, can be started during the folding process. This can put ahead the starting time for moving the alignment members 127*b*, 127*c*. As a result, the amount of time required for preparation for a subsequent process can be reduced, leading to reduction in total time required for the folding process.

It should be noted that, although the prior moving unit 406 is configured to move the alignment members 127*b*, 127*c* from the folding positions to the home positions according to a position of the end of the stack of paper being moved in the folding process in the embodiment of the present disclosure, the present disclosure is not limited thereto. For example, the prior moving unit 406 can be configured to move the alignment members 127*b*, 127*c* to the alignment positions corresponding thereto, instead of the home positions. In such a configuration, the alignment members 127*b*, 127*c* can be moved to the alignment positions without moving the alignment members 127*b*, 127*c* to the home positions, thereby reducing the time required for the subsequent folding process.

In addition, although the stack of paper composed of a plurality of sheets (for example, 3 sheets) of paper has been described in the embodiment of the present disclosure, the same operation and effect can be obtained with a sheet of paper.

Furthermore, although the center-binding unit 404 is provided in the embodiment of the present disclosure, the center-binding unit 404 can be omitted.

Moreover, the paper mount 127*a* of the folding device 127 that is at a predetermined angle with respect to a horizontal direction (ground) is employed in the embodiment of the present disclosure; however, the present disclosure is not limited thereto. For example, even if the paper mount 127*a* is arranged horizontally, the same operation and effect can be obtained.

In addition, the downstream alignment member 127*b* and the upstream alignment member 127*c* are employed in the embodiment of the present disclosure; however, the present disclosure is not limited thereto. For example, other types of a plurality of alignment members can be provided. And more than two alignment members can be provided. Furthermore, although the endless belt and the detection sensors are employed as a moving control method, the present disclosure is not limited thereto. The same operation and effect can be obtained by other moving control method.

In addition, a moving speed of the downstream alignment member 127*b* moved by the prior moving unit 406 is set to be lower than a moving speed of the end 801 of the paper moved in the folding process in the embodiment of the present disclosure; however, the present disclosure is not limited thereto. Design changes can be appropriately made to the prior moving unit 406, for example by making the moving speed of the downstream alignment member 127*b* constant or by accelerating and then decelerating the speed, in order to avoid interference between the downstream alignment member 127*b* and the downstream end 801 of the stack of paper.

Furthermore, in the embodiment of the present disclosure, the finisher 125 including the folding device 127 has been described. The same operation and effect can be obtained with the folding device 127 alone.

Moreover, in the embodiment, the present disclosure is employed for processing of the copy function of the multifunction peripheral 100 with the finisher 125 including the folding device 127; however, the present disclosure can also be employed for the printing function and the like.

In addition, in the embodiment of the present disclosure, the folding device 127 includes the units; however, the present disclosure can be configured such that the multifunction peripheral 100 includes the units. Alternatively, a storage medium that stores a program realizing the units can be provided. In such a configuration, the program is read by the folding device 127 or the multifunction peripheral 100 and then the folding device 127 or the multifunction peripheral 100 realizes the units. In this case, the program read from the recording medium itself provides the operation and effect of the present disclosure. Alternatively, steps executed by the various units can be provided as methods stored in a hard disk.

The present disclosure may also be provided as a program to be executed by a computer, independently distributed through telecommunication lines or the like. In this case, central processing unit (CPU) realizes a control operation in cooperation with other circuits according to the program of the present disclosure.

The program can be made available in a state of being recorded on a computer-readable recording medium, such as a CD-ROM.

INDUSTRIAL APPLICABILITY

As described above, the folding device and a sheet folding method according to the present disclosure are useful not only in a finisher, but also in a multifunction peripheral, a copy machine, a printer and the like, provided with a finisher. The folding device and the sheet folding method according to the present disclosure is useful as the folding device and the sheet folding method that can improve efficiency (productivity) of a folding process.

The invention claimed is:

1. A method for performing a folding process on paper which is conveyed from an image forming apparatus, by using a folding device comprising an alignment member moving unit to move an alignment member, a folding unit, a prior moving unit, and a detection unit, the image forming apparatus being connected to the folding device, the method comprising:

moving the alignment member from a home position to a predetermined alignment position upon conveyance of the paper subjected to the folding process from the image forming apparatus;

moving the alignment member from the alignment position to a predetermined folding position upon performing the folding process on the paper;

positioning the paper aligned by the alignment member at the predetermined folding position;

moving the alignment member from the predetermined folding position to the home position or the alignment position according to a position of the end of the paper moved in the folding process;

detecting a downstream end of the paper at a predetermined position on a path of the paper moved in the folding process, wherein the alignment member includes a downstream alignment member configured to align the downstream end of the paper, and wherein the detection unit is provided at a predetermined position between a downstream folding position of the downstream alignment member and a downstream home position of the downstream alignment member; and moving the downstream alignment member to the downstream home position or a downstream alignment position when the detection unit detects the downstream end of the paper moved in the folding process.

* * * * *